United States Patent [19]

Morihashi et al.

[11] Patent Number: 4,942,731

[45] Date of Patent: Jul. 24, 1990

[54] SPINNING METHOD AND SPINNING APPARATUS

[75] Inventors: Toshifumi Morihashi, Ohtsu; Shoji Sakai, Nagaokakyo; Teruo Nakayama, Ohtsu; Koshi Noda, Joyo; Michiaki Fujiwara, Kameoka, all of Japan

[73] Assignee: Murata Kikai Kabushiki Kaisha, Kyoto, Japan

[21] Appl. No.: 281,092

[22] Filed: Dec. 7, 1988

[30] Foreign Application Priority Data

Dec. 14, 1987 [JP] Japan ..... 62-315774

[51] Int. Cl.[5] ..... D01H 13/04

[52] U.S. Cl. ..... 57/328; 57/315

[58] Field of Search ..... 57/328, 315, 330, 331

[56] References Cited

U.S. PATENT DOCUMENTS

| | | | |
|---|---|---|---|
| 4,351,146 | 9/1982 | Faure et al. | 57/328 X |
| 4,387,487 | 6/1983 | Nakahara et al. | 57/328 X |
| 4,484,436 | 11/1984 | Nakayama et al. | 57/328 |
| 4,711,080 | 12/1987 | Shibazaki et al. | 57/328 X |

FOREIGN PATENT DOCUMENTS

| | | | |
|---|---|---|---|
| 35050 | 4/1978 | Japan | 57/328 |
| 3988 | 2/1979 | Japan | 57/328 |
| 515672 | 3/1938 | United Kingdom | 57/328 |

*Primary Examiner*—Joseph J. Hail, III

*Attorney, Agent, or Firm*—Spensley Horn Jubas & Lubitz

[57] ABSTRACT

A spinning apparatus which includes a drafting device, a twisting device and a take-up device is constituted such that the spinning apparatus further includes a guide device for guiding the fiber bundle in the separated condition in a plurality of rows and the twisting device includes a plurality of rows of twisting mechanism which can twist a plurality of rows of fiber bundle at a time.

3 Claims, 2 Drawing Sheets

SPINNING METHOD AND SPINNING APPARATUS

FIELD OF THE INVENTION

This invention relates to a spinning method and a spinning apparatus for putting the method into practice.

RELATED ART STATEMENT

Spinning apparatus are already known wherein a fiber bundle such as a sliver is introduced into a drafting device and a fiber bundle drafted by the drafting device is twisted by an air jetting nozzle, a temporarily spinning device of the nip belt type or the like to form a spun yarn (for example, by Japanese Patent Publication No. 60-47937). Such spinning apparatus are generally called innovative spinning machines in contrast to conventional ring spinning machines.

Such innovative spinning machines as described above have an advantage that the spinning speed is high and another advantage that a package obtained can have a desired configuration such as a cheese or a cone. On the other hand, however, they have a negative aspect that generally the yarn strength is low.

Meanwhile, as means for increasing the yarn strength, a method of arranging two yarns properly to make a double yarn is known, but in order to make a double yarn from yarns obtained on such an innovative spinning machine as described above, a doubler or some doubling step is required anew.

In particular, whether two packages produced on an innovative spinning machine are used and rewound into a double yarn using such a doubler as described above or two yarns from two spinning sections are wound directly into a double yarn on an innovative machine on which two spindles are constituted into a single common winding section, the productivity of the spinning apparatus is reduced to one half.

In short, concretely in order to obtain a yarn, for example, of the 30 yarn count having a high quality and a high strength, where the method described above is employed, yarns of the 60 yarn count are produced in advance on a spinning apparatus, and using two packages of the yarns is used and formed into a double yarn by a doubler to obtain a package of a yarn of the 30 yarn count.

OBJECT AND SUMMARY OF THE INVENTION

It is an object of the present invention to provide a method and an apparatus by which a single double yarn can be obtained for one spindle. According to the present invention, a good yarn having a high strength can be produced without causing such disadvantages as described above.

According to the present invention, a spinning method wherein a fiber bundle after being drafted is introduced into a twisting device in which it is further formed into a yarn and then it is taken up onto a package by a take-up device is constituted such that, at the position of the twisting device and at least at one position other than the position on the upstream side of the twisting device, a fiber bundle is separated into a plurality of rows more than two to pass the step. Meanwhile, according to the present invention, a spinning apparatus which includes a drafting device for drafting a fiber bundle, a twisting device for applying a twist to the fiber bundle having passed the drafting device, and a take-up device for taking up a spun yarn delivered from the twisting device is constituted such that the twisting device includes a plurality of rows of twisting mechanisms which can twist a plurality of rows of fiber bundles more than two at a time, and a guide device for guiding the fiber bundle in the separated condition in a plurality of rows more than two.

DETAILED DESCRIPTION OF PREFERRED EMBODIMENTS

In the following, an embodiment will be described with reference to the drawings.

Figure 1:
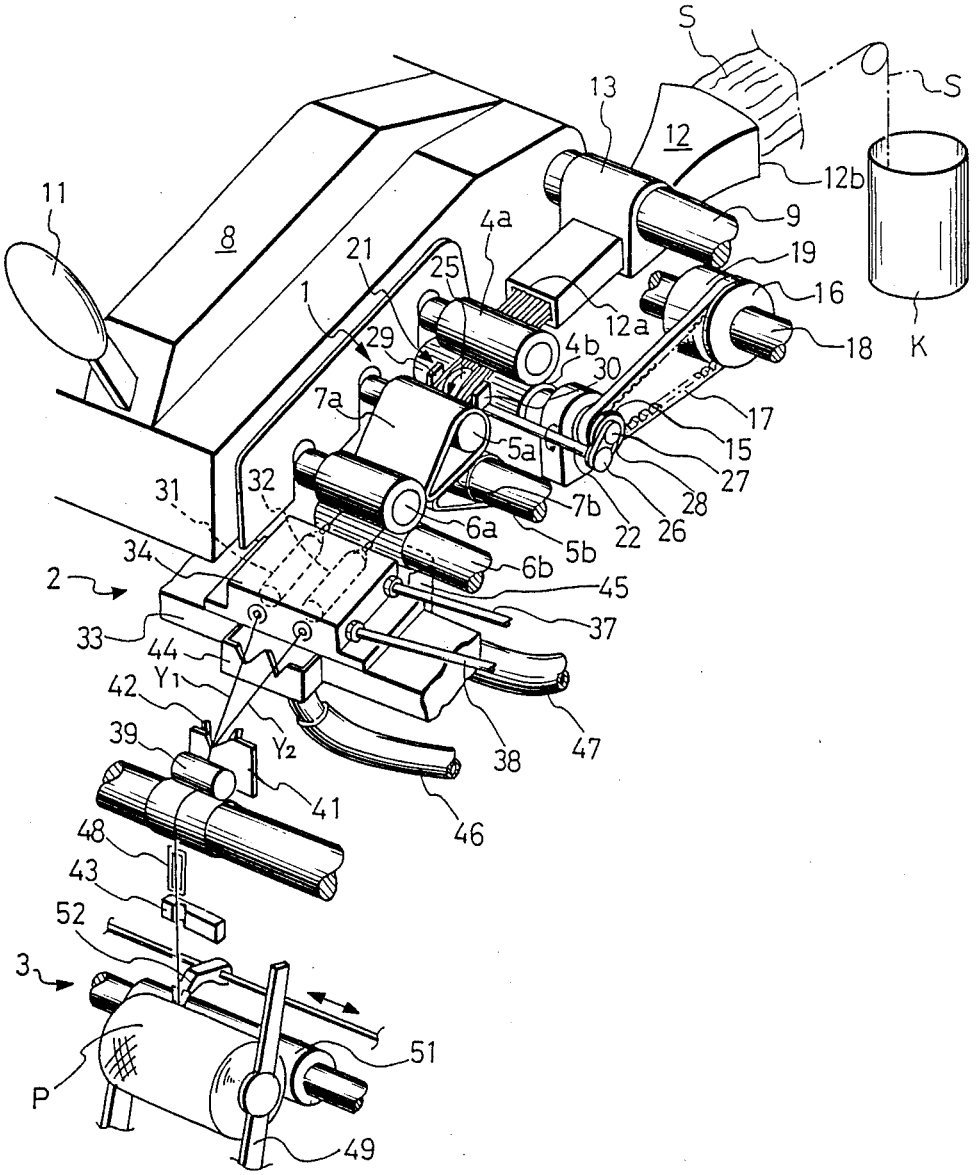
FIG. 1 is a perspective view of a spinning machine according to the present invention, FIG. 2 a plan view of a drafting device, FIG. 3 an explanatory view of an air jetting nozzle, and FIG. 4 a plan view showing another example of sliver guide.

FIG. 1 is a perspective view showing a spindle of a spinning apparatus according to the present invention, and the spinning apparatus is constituted from a drafting device 1 for drafting a sliver S supplied from a sliver can K, a twisting device 2 for applying a twist to the sliver S drafted by the drafting device 1 to form the sliver S into a yarn, and a take-up device 3 for taking up the yarn thus spun out.

In the following, the individual devices 1, 2 and 3 will be described.

In particular, the drafting device 1 is composed of a pair of back rollers 4*a* and 4*b*, a pair of middle rollers 5*a* and 5*b* and a pair of front rollers 6*a* and 6*b* the circumferential speeds of which are set so as to increase in this order, and the middle rollers 5*a* and 5*b* have a pair of apron belts 7*a* and 7*b*, respectively.

Reference numeral 8 denotes a cradle for supporting thereon the top side rollers 4*a*, 5*a* and 6*a* of the individual rollers, and the cradle 8 is mounted for pivotal motion around a support shaft 9 fixed to a frame. Reference numeral 11 denotes a knob for lifting the cradle 8, and 12 a guide for a sliver mounted on the support shaft 9 by means of a bracket 13, and the guide 12 has an exit 12*a* which has a horizontally flattened configuration so that a sliver S may have a somewhat horizontally elongated cross section when it is sent to the back rollers 4*a* and 4*b*.

The individual rollers 4*a*, 5*a*, 6*a*, 4*b*, 5*b* and 6*b* are arranged such that the bottom side middle and front rollers 5*b* and 6*b* are mounted on line shafts extending through all of the spindles so that they may be rotated as the line shafts are driven, but as for the back rollers 4*a* and 4*b*, the bottom side rollers 4*b* for the individual spindles are independent of each other and a line shaft 18 is operatively connected to each of the rollers 4*b* by way of a pair of toothed pulleys 15 and 16 and a toothed belt 17 so that the rollers 4*b* may be rotated by the line shaft 18. It is to be noted that an electromagnetic clutch 19 is interposed in the toothed pulley 16 so that the back rollers 4*a* and 4*b* may be controlled to start or stop for each spindle by engagement or disengagement of the clutch 19.

And, in the present embodiment, such a sliver separating guide device 21 as described below is provided between the back rollers 4*a* and 4*b* and the middle rollers 5*a* and 5*b*.

Figure 2:
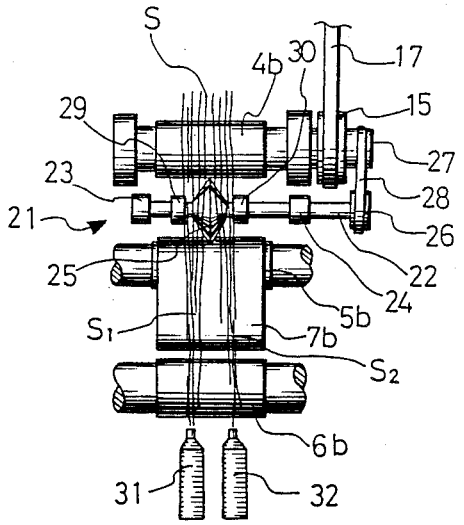

In particular, as shown in FIG. 2, another shaft 22 is supported for rotation as at 23 and 24 between the back rollers 4a and 4b and the middle rollers 5a and 5b, and a rotary member 25 having a substantially diamond-shaped vertical section is secured to the shaft 22. A pulley 26 is secured to an end of the shaft 22 and connected by way of a belt 28 to a toothed pulley 27 secured to the pulley 15 so that the rotary member 25 may be rotated in the same direction and at a substantially same speed as the back rollers 4a and 4b between the back rollers 4a and 4b and the middle rollers 5a and 5b.

The rotary member 25 is positioned at the center in the widthwise direction of a path of a sliver S such that a circumferential edge portion thereof may extend upwardly across the path of the sliver S so as to separate the sliver S delivered from the back rollers 4a and 4b into two rows $S_1$ and $S_2$ of the same width.

Meanwhile, a pair of guide blocks 29 and 30 are secured to the frame leftwardly and rightwardly of rotary member 25 so that they may restrict leftward and rightward expansion of the two rows of slivers $S_1$ and $S_2$ separated by the rotary member 25.

Accordingly, the two rows of slivers $S_1$ and $S_2$ separated at the position of the rotary member 25 are subsequently drafted while maintaining the condition of the two parallel rows also at the position of the middle rollers 5a and 5b and at the position of the front rollers 6a and 6b, and then they are introduced into air jetting nozzles 31 and 32 which will be hereinafter described.

Figure 4:
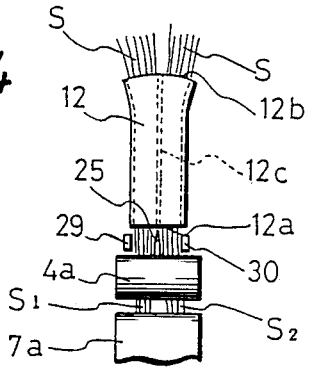

It is to be noted that the position of the rotary member 25 may be between the back rollers 4a and 4b and the sliver guide 12, and in this instance, if a partition wall 12c for separating the inside of the sliver guide 12 into two left and right chambers is provided in the sliver guide 12 as shown in FIG. 4 so that a sliver S may be introduced in two rows already at the position of an entrance 12b of the sliver guide 12, then separation can be attained well. In other words, in this instance, either two separate slivers are already contained in the single sliver can K or two slivers are supplied from two sliver cans.

In the meantime, while a fixed separating guide member may be employed in place of the rotary member 25, where a fixed guide is employed, since there is the possibility that a sliver S advancing at a predetermined speed in the drafting device 1 may be contacted with and bent by the fixed guide member to produce so-called hook fibers, preferably the sliver separating guide device is a moving member such as the rotary member 25 which moves at a substantially same speed as the moving speed of the sliver S at the position.

Subsequently, the twisting device 2 will be described. The twisting device 2 in the example includes a pair of air jetting nozzles 31 and 32 provided in two parallel rows in a housing 34 secured to a frame 33 and each composed of two air nozzles 35 and 36 provided in series to each other (the upstream side one of the nozzles will be hereinafter referred to as first nozzle 35, and the downstream side one as second nozzle 36). Each of the air jetting nozzles 31 and 32 has a function to independently apply a twist to a sliver $S_1$ or $S_2$ supplied thereto to form a spun yarn $Y_1$ or $Y_2$.

Since the air jetting nozzles 31 and 32 have a same mechanism, only one side of them will be described in the following.

Figure 3:
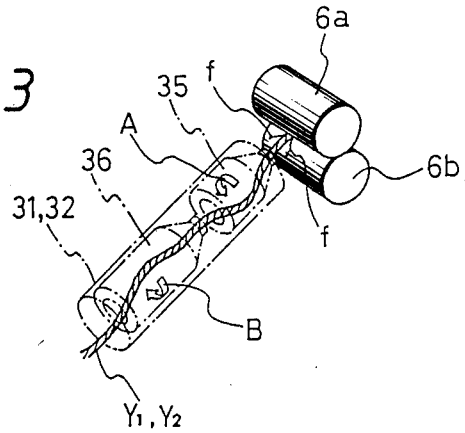

In particular, as shown in FIG. 3, each of the first and second nozzles 35 and 36 has a plurality of fine air jetting holes (not shown) provided therein for jetting air in tangential directions toward the inside of a path for a sliver S which is formed through the center axis of the first or second nozzle 35 or 36 so that air flows which whirl in the mutually opposite directions indicated by arrow marks A and B may be formed in the path by the fine air jetting holes. Reference numerals 37 and 38 denote supply pipes for supplying compressed air to the first nozzle 35 and the second nozzle 36, respectively.

A spinning process by each of the air jetting nozzles 31 and 32 proceeds as follows.

A sliver S introduced into the path is temporarily twisted in the direction of the whirling air flow B by the whirling air flow B, and the temporary twist is propagated to a location of the sliver S near a nip point by the front rollers 6a and 6b.

The sliver S delivered from the front rollers 6a and 6b is then bundled by a temporary twist by the second nozzle 36. However, between the front rollers 6a and 6b and the first nozzle 35, the sliver S is ballooning in a direction opposite to the direction of the temporary twist, and by such ballooning, fibers (open end fibers) f are produced which have trailing ends still clamped between the front rollers 6a and 6b and remaining in the other fibers constituting the sliver but are made free at leading ends thereof. The fibers f are wrapped in the opposite direction to the direction of the temporary twist by the second nozzle 36 by the ballooning in the opposite direction to the direction of the temporary twist between the front rollers 6a and 6b and the first nozzle 35 and by the air flow A of the first nozzle 35. And, the fibers f are wrapped, at a step wherein they pass through the second nozzle 36 to untwist the temporary twist thereof, further strongly around a core fiber bundle with a sufficient wrapping number in the opposite direction to the direction of the inserted temporary twist, thereby forming a so-called fasciated spun yarn.

The spun yarns Y delivered from the air jetting nozzles 31 and 32 are drawn out by a delivery roller 39, but the two spun yarns Y are arranged properly and doubled at the position of a guide plate 41 provided directly before the delivery roller 39 and then taken up by the take-up device 3 which will be hereinafter described.

Accordingly, the two rows of air jetting nozzles 31 and 32 may not be parallel to each other and have such a V-shaped arrangement that they individually extend between the position of the guide plate 41 (doubling position) and the positions of sliver exists of the front rollers 6a and 6b, or such an arrangement may also be employed that the individual first nozzles 35 and 35 extend parallel to each other and only the individual second nozzles 36 and 36 are directed to the position of the guide plate 41 (doubling position).

It is to be noted that reference numeral 42 denotes a cutter provided at the position of the guide plate 41, and the cutter 42 is rendered operative in response to a yarn defect detection signal from a slub catcher 43 for detecting a yarn defect portion which is provided intermediately along a yarn path which passes the delivery roller 39 and moves down to the take-up device 3.

Reference numerals 44 and 45 denote each a dust sucking port for waste yarns, fly waste and so on, and 46 and 47 denote each a sucking pipe for air.

Meanwhile, reference numeral 48 denotes a yarn slack taking up suction pipe called a slack tube for sucking, upon starting of spinning or upon splicing of a yarn, yarns spun out from the air jetting nozzles 31 and 32 to prevent a slack of the yarns.

The take-up device 3 is constituted from a bobbin supported on a known cradle arm 49, a friction roller 51 for contacting with the bobbin (or a package) to driving the bobbin to rotate, and a traverse guide 52.

It is to be noted that, if the air jetting nozzles 31 and 32 are designed such that the whirling directions of the individual first and second nozzles 35 and 36 are made opposite to each other on the left and right sides so that the wrapping directions of peripheral fibers of bound spun yarns spun out from the individual air jetting nozzles 31 and 32 may be opposite to each other, that is, one of the bound spun yarns may be an S twist yarn while the other is a Z twist yarn, then the material characteristics of the bound spun yarns after formation into a double yarn can be better, due to an action of canceling the directivities of them with each other, than those of a double yarn which is formed from yarns of the S twist or the Z twist.

Anyway, with the spinning apparatus of the example described above, a sliver S supplied from the sliver can K is separated into two rows (three or more rows are also possible depending upon the configuration of the separating guide device 21) at any position in the course of a route at least to the position of the middle rollers 5*a* and 5*b* of the drafting device 1 and then passes at least between and drafted by the middle rollers 5*a* and 5*b* and the front rollers 6*a* and 6*b* while maintaining the separated condition thereof.

Accordingly, the two rows of slivers S1 and S2 coming out of the front rollers 6*a* and 6*b* are individually drafted desirably and then introduced into the individual air jetting nozzles 31 and 32 by which they are spun out as two spun yarns Y1 and Y2 whereafter they are arranged properly at the position of the guide plate 41, then drawn out by the delivery roller 39 and taken up onto a single package P.

And, a yarn defect of the spun yarns Y1 and Y2 coming out of the twisting device 2 is detected by the slub catcher 43, and in response to such a detection signal, the aforementioned cutter 42 is rendered operative to cut the yarns. Also the electromagnetic clutch 19 is disengaged in response to the detection signal, and as rotation of the back rollers 4*a* and 4*b* is stopped, spinning out from the twisting device 2 is also stopped.

In short, yarn cutting and starting and stopping of spinning out are performed at the same time for the two rows of slivers S1 and S2 and yarns Y1 and Y2.

It is to be noted that the slub catcher 43 can detect, in addition to detection of a yarn defect portion, presence or absence of running of a yarn, that is, occurrence of natural break of a yarn.

As apparent from the foregoing description, in accordance with the present invention, a single double yarn package can be obtained without reduction in productivity, that is, for one spindle, and besides a package thus obtained is better than a single yarn package which is obtained on a conventional innovative spinning machine.

What is claimed is:

1. A spinning apparatus, comprising:

a drafting device for drafting a fiber bundle, a twisting device for applying a twist to the drafted fiber bundle, the twisting device comprising a pair of false twisters, a take-up device for taking up yarn delivered from the twisting device, separating means for separating the fiber bundle into two secondary bundles, a secondary bundle combining device providing downstream of the separating means, a fiber bundle guide provided upstream of the drafting device, wherein the separating means is located between the fiber bundle guide and the drafting device.

2. The spinning apparatus as claimed in claim 1, wherein the separating means further comprises, a rotary member having a substantially diamond-shaped vertical section secured to a shaft and supported for rotation thereon, located between the fiber bundle guide and the drafting device, and means for rotating the rotary member.

3. The spinning apparatus as claimed in claim 1, wherein the fiber bundle guide has an exit which has a horizontally flattened configuration and a partition wall separating the fiber bundle guide into two chambers.

* * * * *